United States Patent [19]

Keefe

[11] 4,013,005

[45] Mar. 22, 1977

[54] PRINT WHEEL AND METHOD OF MAKING SAME

[75] Inventor: Jack D. Keefe, Dayton, Ohio

[73] Assignee: Monarch Marking Systems, Inc., Dayton, Ohio

[22] Filed: Sept. 18, 1973

[21] Appl. No.: 398,519

[52] U.S. Cl. ..... 101/110; 101/426; 101/376

[51] Int. Cl.[2] ..... B41J 1/22

[58] Field of Search ..... 101/109, 110, 111, 375, 101/376–378, 426, 415.1; 29/451; 83/659, 698

[56] References Cited

UNITED STATES PATENTS

| | | | |
|---|---|---|---|
| 2,052,758 | 9/1936 | Foster | 101/375 |
| 2,211,794 | 8/1940 | Rohland | 101/376 |
| 2,784,668 | 3/1957 | Paje | 101/109 |
| 2,978,751 | 4/1961 | Bright | 101/110 X |
| 3,217,644 | 11/1965 | Schmidt | 101/415.1 |
| 3,347,162 | 10/1967 | Braznell et al. | 101/376 |
| 3,542,620 | 11/1970 | Dehek | 101/110 X |
| 3,739,675 | 6/1973 | Duckett et al. | 83/659 |
| 3,765,329 | 10/1973 | Kirkpatrick et al. | 101/415.1 |

*Primary Examiner*—Edward M. Coven
*Attorney, Agent, or Firm*—Joseph J. Grass

[57] ABSTRACT

There is disclosed a print wheel and method of making same. The print wheel is comprised of an annular base, a flexible printing band molded flat and brought at least partially around the base, and adhered to the base.

15 Claims, 10 Drawing Figures

FIG-1
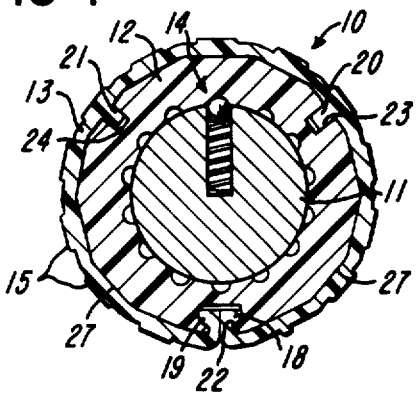
FIG-2
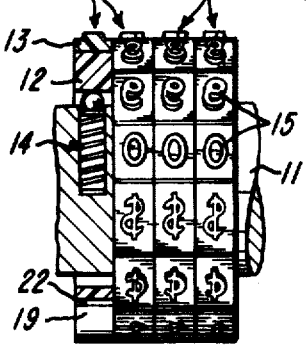
FIG-3
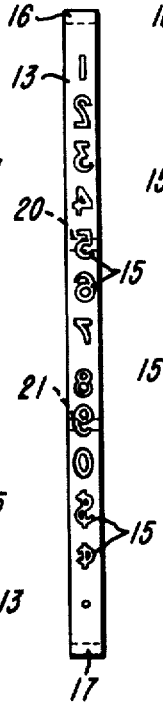
FIG-4
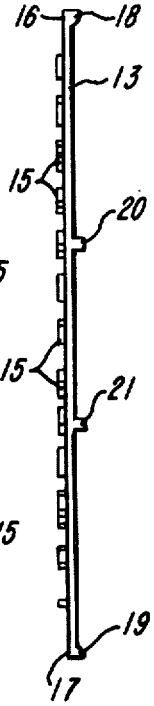
FIG-7
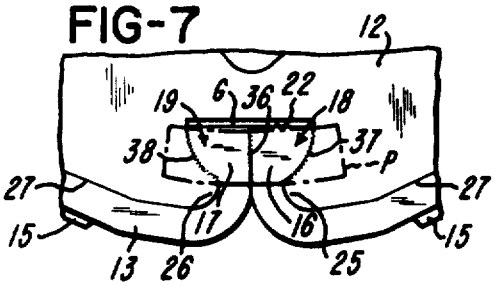
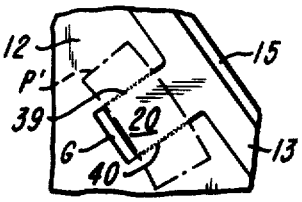
FIG-8
FIG-5
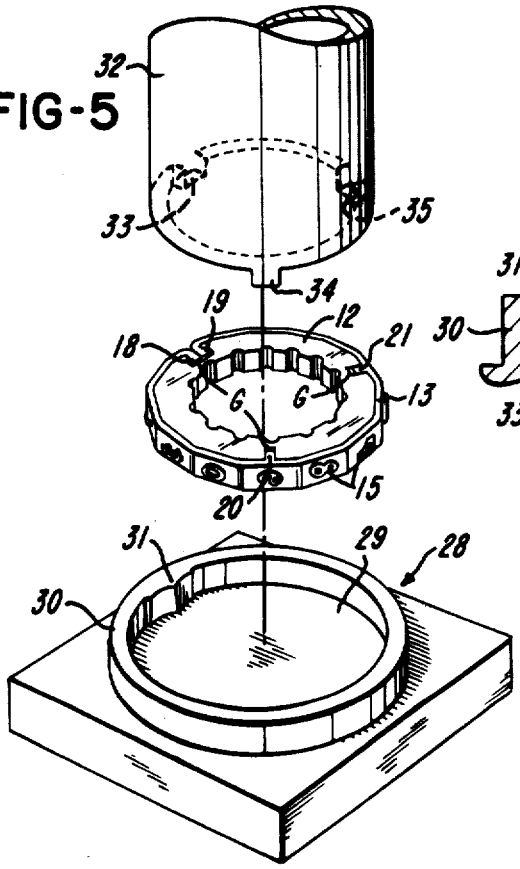
FIG-6
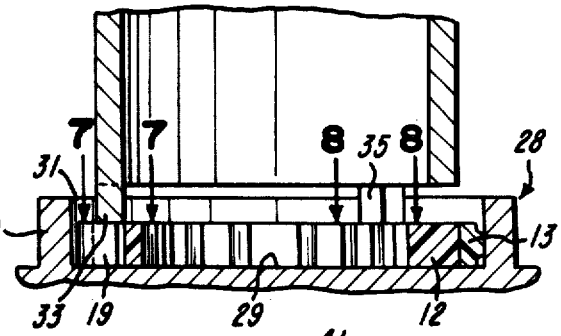
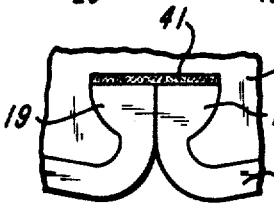
FIG-9
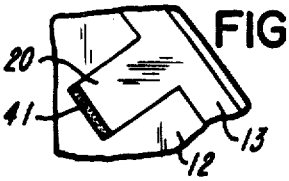
FIG-10

PRINT WHEEL AND METHOD OF MAKING SAME

BACKGROUND OF THE INVENTION

1. Field of the Invention

This invention relates to the art of print wheels and methods of making same.

2. Brief Description of the Prior Art

It has been proposed in U.S. Pat. No. 2,978,751 to make a unitary print wheel by forming a printing band, arranging the printing band in a circle, and pouring thermoplastic material into the circle to bond to the printing band. It is known in the art to secure a flexible printing band to the continuous outer surface of a generally annular printing base as shown in U.S. Pat. No. 2,784,668. It is also known to mold annular print wheels in an annular mold in which the cavities for forming the type characters of the print wheel are arranged around the periphery of the mold cavity.

SUMMARY OF THE INVENTION

It is a feature of the invention to provide an improved method of making a print wheel starting with a molded or embossed printing band and a generally annular base. The base has one and preferably more recesses in its periphery. The printing band is wrapped at least partially around the base and its ends are inserted into the recess. The marginal ends of the band can be adhered to each other or one or both of the ends are adhered to the base. Preferably the marginal ends are adhered to each other and also to the base. The printing band can also have one or more lugs on its underside between its ends which fit into corresponding recesses in the base. It is preferred that the ends of the bands also be provided with complementary lugs which can lock the ends of the printing band into an undercut recess in the base. It is also preferred that the assembly of the printing band and base be placed on a work support so that the printing band and the base can be properly aligned relative to each other. Then a horn such as an ultrasonic horn or a heated welding member can be brought against the side of the assembly to fuse the printing band to the base. In one illustrated embodiment, only the lugs are welded to the base in that this is adequate to unitize the assembly. Alternately, the printing band can be held on the base by a press-fit between the lugs on the printing band and recess means in the base. Alternately, the lugs can be adhesively secured to the base.

BRIEF DESCRIPTION OF THE DRAWINGS

FIG. 1 is a sectional view through a print wheel made in accordance with the invention;

FIG. 2 is an elevational view, partly in section, of a plurality of print wheels mounted on a shaft;

FIG. 3 is a top plan view of a printing band in the flat, as molded, state;

FIG. 4 is a side elevational view of the printing band;

FIG. 5 is an exploded perspective view showing a welding set-up by which the assembly can be unitized;

FIG. 6 is a sectional view showing the lugs of the printing band being welded to the base;

FIG. 7 is a fragmentary view taken along line 7—7 of FIG. 6;

FIG. 8 is a fragmentary view taken generally along line 8—8 of FIG. 6; and

FIGS. 9 and 10 are views similar to respective FIGS. 7 and 8 but showing an alternative arrangement for adhering the printing band to the base.

DESCRIPTION OF THE PREFERRED EMBODIMENTS

Referring to FIG. 1, there is shown a print wheel generally indicated at 10 rotatably received on a shaft 11. The print wheel 10 is shown to comprise a generally annular base 12 and a flexible printing band 13. The print wheel 10 can be held by means of a detent 14 in any selected print position relative to a platen (not shown) to print the selected character. FIG. 2 illustrates a plurality of type wheels 10 carried by the shaft 11, there being a detent 14 individual to each respective wheel 10.

Referring to FIGS. 3, 4 and 5, the printing band 13 is shown to comprise a generally flat one-piece strip with integrally formed, raised, type characters 15 on its upper or outer side. Although the printing band 13 can have any suitable characters, the numbers "1" through "9" and "0" and the dollar sign "$," cent sign "¢," and period "." are illustrated.

The printing band 13 has opposed marginal ends 16 and 17. Lugs 18 and 19 are preferably formed integrally with the underside of the printing band 13 at respective ends 16 and 17. Spaced apart lugs 20 and 21 are also preferably formed integrally with the underside of the printing band 13 between the ends 16 and 17.

In the illustrated embodiment the printing band 13 is assembled onto the base 12 by inserting lugs 18 and 19 into undercut recesses 22 and by inserting the lugs 20 and 21 into respective recesses 23 and 24 from one side of the base while the printing band 13 is brought around the base 12. Thus, the base 12 and the printing band 13 are formed into an assembly as illustrated in FIG. 5. As seen in FIG. 7, the ends 16 and 17 are held captive, that is, in locked relationship in the undercut recess 22. With the exception of the characters 15, the upper surface of the band is illustrated to be plain. The upper surface of the band 13 at the ends 16 and 17, is shown in contact. The lugs 18 and 19 are complementary to each other in that together they prevent the ends 16 and 17 from moving radially outwardly of the base. This is because the combined thickness of the lugs 18 and 19 is greater than the width of the gap between portions 25 and 26 of the base 12. It is preferred to make the lugs 18 and 19, 20, and 21 slightly oversize and to press-fit them into respective recesses 22, 23 and 24; by this arrangement the need for adhering as by fusing or adhesively joining the printing band 13 to the base 12 can be obviated for many of the applications in which the print wheel 10 can be used. In assembling the band 13 onto the base 12 as shown in FIG. 5, the band 13 is placed under a small amount of tension as the lugs 18 and 19, 20 and 21 are inserted into respective recesses 22, 23 and 24. The band 13 is held on the base 12 under tension because the length of the printing band around the periphery of the base 12 is less than the peripheral extent of the base 12. More specifically, before assembly of the band 13 onto the base 12: the distance between the lugs 20 and 21 is less than the peripheral distance around the base 12 between the recesses 23 and 24, the distance between the lugs 18 and 20 is less than the peripheral distance around the base 12 between the recesses 22 and 23, and the distance between the lugs 19 and 21 is less than the peripheral distance around the base 12 between the recesses 22 and 24. The tension is, however, insufficient to cause printing distortion. Accordingly, the band 13 conforms exactly to the contour of the periphery of the base 12. As shown in the drawings, the outer surface of the base 12 has chordal flats 27 corresponding to the respective characters 15. Thus, the outer surface of the type characters 15 is flat. This arrangement is preferred for bed-and-platen type of printing. For rolling contact type of printing it is preferred that the periphery of the base 12 be circular, in which event the outer surface of the type characters will be arcuate.

With reference to FIGS. 5 and 6, the assembly of the base 12 and the printing band 13 can be unitized by fusing the printing band 13 to the base 12. This can be accomplished by placing it in a jig generally indicated at 28. The jig 28 has a flat upper surface or work support 29 and an upstanding wall 30. The work support 29 is used to align the one side of the base 12 and one side of the band 13. Alignment is accomplished by pressing downwardly (as viewed in FIG. 6) on both the base 12 and the band 13 either manually or by means of a plunger (not shown). The wall 30 is generally circular in shape and there is only a slight amount of clearance between the outer periphery of the assembly of the base 12 and band 13 and the inner surface of the wall 30. A projection 31 on the wall 30 extends inwardly and complements the surface of the band 13 adjacent the ends 16 and 17 in the area shown in FIG. 7. Thus, the assembly can have only one position of orientation relative to the jig 28 while the assembly is positioned in the jig 28. Welding means 32, which can comprise a heated element or an ultrasonic horn or similar means having contact portions 33, 34 and 35, is moved toward the assembly. The contact portion 33 spans the lugs 18 and 19 and the adjacent portions of the base 12 as indicated by phantom lines P in FIG. 5. Thus, the marginal ends 16 and 17 are fused to each other by a weldment indicated by dotted line 36, the end 16 is fused to the base 12 by a weldment indicated by dotted line 37, and the end 17 is fused to the base 12 by a weldment indicated by dotted line 38. If desired, the contacting portion can be sized to fuse the ends 16 and 17 to each other only along the dotted line 36, or only along one or both of the dotted lines 37 and 38. It is preferred to simply size the contacting portion 33 to make all the weldments 36, 37 and 38. In like manner, the contacting portions 34 and 35 cause the respective lugs 20 and 21 to be fused to the base 12. The weldments at the lugs 20 and 21 are identical so only the ones for the lug 21 are illustrated in detail. The lug 21 is shown to be fused to the base 12 by weldments indicated by dotted lines 39 and 40. The contact portion 35 spans the lug 21 and the adjacent portions of the base 12 as indicated by phantom lines P'.

The embodiment of FIGS. 9 and 10 is identical to the embodiment of FIGS. 1 through 8, except that instead of fusing some or all the lugs 18, 19, 20 and 21 to the base 12, a suitable adhesive 41 is applied in the gap G so that the lugs 18 and 19 are adhered to each other and to the base 12 and so that the lugs 20 and 21 are adhered to the base 12.

The printing band in the foregoing embodiments is composed of a suitable thermoplastic polymeric material such as Polyacetal, ABS, Nylon or Polycarbonate, which will allow the band 13 to be fused or welded at weldment 36. In the event the band is also to be fused or welded to the base 12 as is preferred, the base 12 should also be composed of a thermoplastic polymeric material such as stated with respect to the printing band. It is convenient to construct the base 12 and band 13 of the same materials.

Although the printing band 13 is shown to extend entirely around the base 12, it can be constructed to extend only partially around the base 12 in which event the end could be received in spaced apart recesses and locked and/or adhered to the base.

Other embodiments and modifications of this invention will suggest themselves to those skilled in the art, and all such of these as come within the spirit of this invention are included within its scope as best defined by the appended claims.

I claim:

1. Method of making a print wheel, comprising the steps of: molding an elongated, unitary, printing band composed of polymeric material and having complementary lugs at its marginal ends, providing a generally annular base having an undercut recess open at the periphery of the base by a gap which is narrower than the combined thickness of the lugs and open at a side of the base and with the length of the band about the periphery of the base being less than the peripheral extent of the base, bringing the band at least partially around the base under tension, and inserting the complementary lugs through the open side into the undercut recess so that the band is maintained on the base under tension.

2. Method of making a print wheel, comprising the steps of: molding an elongated, unitary, printing band composed of polymeric material and having complementary lugs at its marginal ends, providing a generally annular base having an undercut recess open at the periphery of the base by a gap which is narrower than the combined thickness of the lugs and open at a side of the base and with the length of the band about the periphery of the base being less than the peripheral extent of the base, bringing the band at least partially around the base under tension, inserting the complementary lugs through the open side into the undercut recess so that the band is maintained on the base under tension, and joining the lugs to the base.

3. Method of making a print wheel, comprising the steps of: molding an elongated, unitary, printing band comprised of polymeric material and having complementary lugs at its marginal ends, providing a generally annular base having an undercut recess open at the periphery of the base by a gap which is narrower than the combined thickness of the lugs and open at a side of the base, bringing the band at least partially around the base, inserting the complementary lugs through the open side into the undercut recess, and thereafter adhering the lugs to each other.

4. Method of making a print wheel, comprising the steps of: molding an elongated, unitary, printing band composed of polymeric material and having complementary lugs at its marginal ends, providing a generally annular base having an undercut recess open at the periphery of the base by a gap which is narrower than the combined thickness of the lugs and open at a side of the base, bringing the band at least partially around the base, inserting the complementary lugs through the open side into the undercut recess, and thereafter adhering the lugs to the base.

5. Method of making a print wheel, comprising the steps of: molding an elongated, unitary, printing band composed of polymeric material and having complementary lugs at its marginal ends, providing a generally annular base having an undercut recess open at the periphery of the base by a gap which is narrower than the combined thickness of the lugs and open at a side of the base, bringing the band at least partially around the base, and inserting the complementary lugs through the open side into the undercut recess.

6. Method of making a print wheel, comprising the steps of: molding a printing band having lug means on its underside using thermoplastic polymeric material, providing a generally annular base composed of thermoplastic polymeric material, bringing the printing band at least partially around the periphery of the base and inserting the lug means into recess means in the base, and thereafter bringing welding means into welding relationship with respect to the lug means and the base to fuse the printing band to the base.

7. Method of making a print wheel, comprising the steps of: molding an elongated, unitary, printing band composed of polymeric material and having lugs at its marginal ends and a plurality of intervening lugs between the lugs at the marginal ends, providing an annular base having a common recess for receiving the lugs at the marginal ends and respective intervening recesses for the intervening lugs with the distance before assembly of the band onto the base between adjacent intervening lugs being less than the peripheral distance between adjacent intervening recesses and the distance between the lugs at the marginal ends of the band and the respective adjacent intervening lugs being less than the distance between the common recess and the respective adjacent intervening recesses, thereafter inserting the lugs into the respective recesses to provide a printing band held on the base under tension, and thereafter adhering at least some of the lugs to the base.

8. Method of making a print wheel, comprising the steps of: molding an elongated, unitary, printing band composed of polymeric material and having lugs at its marginal ends and an intervening lug between the lugs at the marginal ends, providing an annular base having a common recess for receiving the lugs at the marginal ends and a respective recess for the intervening lug with the distances before assembly of the band onto the base between the intervening lug and the respective lugs at the marginal ends of the band being less than the respective peripheral distances between the intervening recess and the common recess, inserting the lugs into the respective recesses to provide a printing band held to the base under tension, and adhering at least some of the lugs to the base.

9. Method of making a print wheel, comprising the steps of: molding an elongated, unitary, printing band composed of polymeric material and having complementary lugs at its marginal ends and an intervening lug between the lugs at the marginal ends, providing an annular base having an undercut recess open at the periphery of the base by a gap which is narrower than the combined thickness of the lugs and open at a side of the base for receiving the lugs at the marginal ends and a respective recess for the intervening lug with the distances before assembly of the band onto the base between the intervening lug and the respective lugs at the marginal ends of the band being less than the respective peripheral distances between the intervening recess and the undercut recess, inserting the lugs into the respective recesses thereby providing a printing band held to the base under tension, and adhering at least some of the lugs to the base.

10. Method of making a print wheel, comprising the steps of: molding an elongated, unitary, printing band composed of polymeric material and having a plurality of lugs, providing a generally annular base having spaced-apart recesses for receiving the lugs, providing welding means having spaced-apart contacting portions corresponding to the lugs, assembling the band onto the base so that the lugs are inserted into the respective recesses, thereafter placing the assembly in a predetermined position of orientation relative to the contacting portions of the welding means, and moving the welding means into welding relation with the lugs and the base so that the contacting portions weld the lugs to the base.

11. A print wheel consisting of two and only two parts, one part comprising a generally annular base having an undercut recess open to the periphery of the base and open to a side of the base, the other part comprising an elongated-unitary, molded printing band having complementary lugs at its marginal ends, the band being wrapped about and supported by the base, the base having a narrow gap at the open end of the recess, the combined thickness of the lugs being greater than the width of the gap so that when the lugs have been inserted into the recess through the side of the base the lugs are held captive in the recess, the lugs being adhered to the base.

12. A print wheel consisting of two and only two parts, one part comprising a generally annular base having an undercut recess open to the periphery of the base and open to a side of the base, and the other part comprising an elongated, unitary, molded printing band having complementary lugs at its marginal ends, the band being wrapped about and supported by the base, the base having a narrow gap at the open end of the recess, the combined thickness of the lugs being greater than the width of the gap, the length of the printing band before being wrapped about the base being less than the peripheral extent of the base so that when the lugs have been inserted into the recess through the side of the base the lugs are held captive in the recess and the band is under tension.

13. A print wheel consisting of two and only two parts, one part comprising a generally annular base having an undercut recess open to the periphery of the base and open to a side of the base, the other part comprising an elongated, unitary, molded printing band having complementary lugs at its marginal ends, the band being wrapped about and supported by the base, the base having a narrow gap at the open end of the recess, the combined thickness of the lugs being greater than the width of the gap, the length of the printing band before being wrapped about the base being less than the peripheral extent of the base so that when the lugs have been inserted into the recess through the side of the base the lugs are held captive in the recess and the band is under tension, the lugs being adhered to the base.

14. A print wheel consisting of two and only two parts, one part comprising a generally annular base having an undercut recess open to the periphery of the base and open to a side of the base, and the other part comprising an elongated, unitary, molded printing band having complementary lugs at its marginal ends, the band being wrapped about and supported by the base, the base having a narrow gap at the open end of the recess, the combined thickness of the lugs being greater than the width of the gap so that when the lugs have been inserted into the recess through the side of the base the lugs are held captive in the recess.

15. A print wheel, comprising: a generally annular base having an undercut recess open to the periphery of the base and open to a side of the base, and an elongated, unitary, molded printing band having complementary lugs at its marginal ends, the band being wrapped about and supported by the base, the base having a narrow gap at the open end of the recess, the combined thickness of the lugs being greater than the width of the gap so that when the lugs have been inserted into the recess through the side of the base the lugs are held captive in the recess.

* * * * *